US006237569B1

(12) United States Patent
Stelzer et al.

(10) Patent No.: US 6,237,569 B1
(45) Date of Patent: May 29, 2001

(54) FUEL INJECTION SYSTEM FOR AN INTERNAL COMBUSTION ENGINE WITH A COMMON RAIL

(75) Inventors: Christian-Paul Stelzer, Tettnang; Juergen Giesselmann, Markdorf; Franz Edmaier, Friedrichshafen; Werner Leicht, Stetten, all of (DE)

(73) Assignee: MTU Motoren-und Turbinen-Union Friedrichshafen GmbH, Friedrichshafen (DE)

( * ) Notice: Subject to any disclaimer, the term of this patent is extended or adjusted under 35 U.S.C. 154(b) by 0 days.

(21) Appl. No.: 09/403,341

(22) PCT Filed: Apr. 16, 1998

(86) PCT No.: PCT/EP98/02228

§ 371 Date: Jan. 21, 2000

§ 102(e) Date: Jan. 21, 2000

(87) PCT Pub. No.: WO98/48165

PCT Pub. Date: Oct. 29, 1998

(30) Foreign Application Priority Data

Apr. 19, 1997 (DE) ..... 197 16 513

(51) Int. Cl.[7] ..... F02M 37/04
(52) U.S. Cl. ..... 123/456
(58) Field of Search ..... 123/456, 468, 123/469, 472

(56) References Cited

U.S. PATENT DOCUMENTS

| | | | | |
|---|---|---|---|---|
| 3,845,748 | | 11/1974 | Eisenberg | 123/32 R |
| 4,702,202 | * | 10/1987 | Hensel et al. | 123/456 |
| 5,392,749 | * | 2/1995 | Stockner et al. | 123/470 |
| 5,411,001 | | 5/1995 | Werner et al. | 123/456 |
| 5,533,485 | | 7/1996 | Bronkal | 123/456 |
| 5,577,477 | * | 11/1996 | Katoh | 123/456 |
| 5,657,733 | * | 8/1997 | Dozier et al. | 123/470 |
| 5,704,334 | * | 1/1998 | Kato | 123/456 |
| 5,803,050 | * | 9/1998 | Osakabe et al. | 123/456 |
| 6,076,505 | * | 6/2000 | Guggenmos et al. | 123/456 |
| 6,109,246 | * | 8/2000 | Takayanagi et al. | 123/456 |
| 6,138,641 | * | 10/2000 | Moser | 123/456 |

FOREIGN PATENT DOCUMENTS

| | | |
|---|---|---|
| 195 08 445 | 9/1996 | (DE) . |
| 0 637 687 | 2/1995 | (EP) . |
| 0 690 221 | 1/1996 | (EP) . |

* cited by examiner

*Primary Examiner*—Thomas N. Moulis
(74) *Attorney, Agent, or Firm*—Evenson, McKeown, Edwards & Lenahan, P.L.L.C.

(57) ABSTRACT

The invention relates to a fuel injection system for an internal combustion engine, specially a diesel engine, comprising a crankcase and cylinder heads. Said system is provided with injectors to inject fuel into the combustion chambers of the internal combustion engine and a high pressure pump which supplies fuel to a common rail supplying fuel to the injectors via high pressure lines. According to the invention, the common rail is lodged in or on the walls of the crankcase. This arrangement of the common rail track and preferably also that of the fuel injectors and the high pressure lines in the housing of the internal combustion engine optimally protects the fuel injection system from external influence and damages while at the same time hermetically closing it from the outside by forming an internal leakage chamber.

25 Claims, 6 Drawing Sheets

FUEL INJECTION SYSTEM FOR AN INTERNAL COMBUSTION ENGINE WITH A COMMON RAIL

BACKGROUND AND SUMMARY OF THE INVENTION

The invention relates to a fuel injection system for an internal-combustion engine particularly a diesel engine, having a crankcase and at least one cylinder head, having fuel injectors for injecting fuel into the combustion spaces of the internal-combustion engine and a common rail supplied with fuel by a high-pressure pump, by which common rail the fuel is fed to the injectors by way of a high-pressure line system.

In the case of internal-combustion engines, particularly large-volume diesel engines, fuel injection systems are used which comprise fuel injectors for injecting fuel into the combustion spaces of the internal-combustion engine, and a so-called common rail which is supplied with fuel by a high-pressure pump, the fuel being supplied by the common rail by way of high -pressure lines to the injectors.

It is generally endeavored to construct internal-combustion engines and their fuel-injection systems in a simpler manner, and to design them to be more maintenance-friendly and less susceptible to disturbances.

From European Patent Document EP 0690 221 A1, a fuel injection system for an internal-combustion engine is known which comprises fuel injectors for injecting fuel into the combustion spaces and a common rail which is supplied with fuel by a high-pressure pump and which supplies fuel by way of high-pressure lines to the injectors. In this case, the common rail is integrated in the wall of a cylinder head cover arranged on the internal-combustion engine. In the above-mentioned document, it is considered to be advantageous that the manufacturing and mounting expenditures are reduced and the common rail is arranged to be protected against vibrations and damage. However, it seems to be a disadvantage that a demounting of the cylinder head cover is not possible without detaching the high-pressure lines connected with the common rail.

Furthermore, from German Patent Document DE-GM 75 15 413, an internal-combustion engine is known which has a fuel injection system in the case of which all ducts required for the guiding of fuel are arranged in a parallel extending manner in an extruded profile, the extruded profile being a component of the engine casing or of the cooling air guiding system. As a result, an operationally reliable, space-saving and easily mountable arrangement of the fuel pipes is to be created. However, here also, it seems to be a disadvantage that, in the event of a demounting of the engine casing or of the cooling air guiding system, which may be required for servicing work, all connections of the fuel ducts to the extruded profile must also be disconnected.

From European Patent Document EP 0637 687 A1, an internal-combustion engine is known in which, for the feeding of fuel to individual injection pumps constructed in the form of plug-type pumps, ducts in the form of bores used as a fuel advancing flow device and as a fuel returning flow device are provided in the cylinder housing of the internal-combustion engine. However, these fuel ducts are used only for the feeding and removal of the fuel to and from the plug-type pumps. However, this is no injection system with a common rail.

Finally, from U.S. Pat. No. 3,845,748, an internal-combustion engine is known in the case of which a fuel injector is arranged in a first bore in the cylinder head of the internal-combustion engine and a tube leading to the fuel injector is arranged for feeding fuel in a second bore leading through the cylinder head, which bore extends at a right angle to the first bore. A ring-shaped space remaining between the fuel feeding tube and the interior wall of the second bore is used as a fuel return device.

It is an object of the invention to provide a fuel injection system for an internal-combustion engine which has a simple construction, is safe in the event of an accident and has a low susceptibility to disturbances.

This object is achieved by providing a fuel injection system with the common rail arranged to be accommodated in or on walls of the crankcase. The fuel injection system according to the invention is provided for an internal-combustion engine, particularly a diesel engine, in which case the internal-combustion engine has a crankcase and one or several cylinder heads. The fuel injection system has fuel injectors for injecting fuel into the combustion spaces of the internal-combustion engine and a common rail supplied with fuel by a high-pressure pump, by which common rail the fuel is supplied by way of a high-pressure line system to the injectors. According to the invention, it is provided that the common rail is accommodated in a duct which is formed at least partially by walls of the crankcase.

It is an advantage of the fuel injection system according to the invention that, as the result of the accommodation of the common rail system according to the invention, a compact method of construction of the internal-combustion engine is permitted. The accommodation in the area of the crankcase does not interfere very much with the course of the contour of the internal-combustion engine and does not limit the narrow space in the area of the cylinder head. The injection system, in particular, is also well protected against outside damage.

According to a further development of the invention, the common rail is arranged in a duct integrated in the crankcase and extending in parallel to the longitudinal axis of the crankcase or is accommodated in a duct formed by the crankcase walls and a charge air tube. As a result, a smooth outer contour of the internal-combustion engine can be implemented without disturbing lines.

According to a further development, the common rail has a tube-shaped construction.

A further development of the invention is particularly advantageous in which the tube-shaped common rail is arranged in a longitudinal bore extending in parallel to the longitudinal axis of the crankcase. In a simple manner, this permits a precisely fitting bearing of the common rail in the radial and axial direction, in which case the common rail can particularly be disposed to be protected from vibrations.

Here, it is particularly advantageous to dispose the tube-shaped common rail, for example, by means of O-rings, in the longitudinal bore. This type of bearing is simple, precisely fitting and protected against vibrations.

It is particularly advantageous to arrange the common rail to be closed off with respect to liquids in the crankcase of the internal-combustion engine.

This is advantageously further developed in that the duct accommodating the common rail forms a liquid-tight leakage chamber which is provided with devices for removing leakage quantities.

In this embodiment, the leakage chamber is advantageously provided with a control bore for indicating the occurring leakage quantities.

In combination with the arrangement of the common rail, it is particularly advantageous to accommodate also the high-pressure lines connecting the injectors with the common rail and the injectors themselves in a closed-off manner in the casing of the internal-combustion engine. This results in a complete protection of the whole injection system against damage by outside influences and permits a completely smooth outer contour of the internal-combustion engine without any lines or projecting parts.

The closing-off of the high-pressure line system advantageously takes place by its arrangement in bores provided in the cylinder head.

The two latter embodiments are advantageously further developed in that the common rail is arranged close to the cylinder head in the crankcase, and in that the common rail has high pressure connections which are accessible through mounting openings provided in the crankcase and/or in the cylinder head, to which high-pressure connections the high-pressure lines are connected which lead to the injectors. In this case, it is particularly advantageous for the mounting openings to be arranged such that the high-pressure connections as well as the injectors and the high-pressure lines are accessible and mountable through these mounting openings. This permits an advantageous reduction of the mounting and servicing expenditures.

The mounting openings can be closed either by closing covers, or the cylinder head can be constructed in several parts, such that the mounting openings are closed by an easily demountable part of the cylinder head.

According to a particularly advantageous embodiment, a charge air tube provided at the internal-combustion engine is constructed as this above-mentioned, easily demountable part of the cylinder head. In this case, it is particularly advantageous for the mounting openings to be provided laterally on the cylinder head and to close them by means of the charge air tube.

Advantageously, the mounting openings and air inlet ducts leading from the charge air tube to the combustion spaces of the internal-combustion engine are arranged essentially in a row in a sealing surface between the cylinder head and the charge air tube. This significantly simplifies the manufacturing of the openings and sealing surfaces on the cylinder head and on the charge air tube. Furthermore, it can be provided and is particularly advantageous in the case of this embodiment that the mounting openings and the air inlet ducts on the sealing surface are sealed off by a common seal.

It is the advantage of the above-mentioned embodiments, in which the mounting openings are closed off by the charge air tube, that no additional mounting covers and fastening parts are required, and that, when an individual cylinder head is exchanged, only the charge air tube and the high-pressure line leading to the injector of the concerned cylinder head must be detached and the common rail and the other high-pressure lines do not have to be demounted.

A further development is particularly advantageous in which the charge air tube has a drain duct, which extends in parallel to the longitudinal crankcase axis, for the accommodation of leakage and control fuel quantities occurring at the injectors, into which drain duct the leakage and control fuel ducts lead which extend to the injectors. This can be further developed such that the leakage and control fuel ducts are connected with the bores accommodating the injectors, in which case the injectors are constructed such that they deliver the leakage and fuel quantities into the bores. This results in a further simplification of the fuel injection system.

In this case, it is advantageous for the leakage and control fuel ducts to extend through the sealing surface containing the mounting openings and to seal them off in the sealing surface by the seal which seals off the mounting openings and the charge air tube with respect to one another.

According to an embodiment, it is provided that the common rail, for the connection of a line leading to the high-pressure pump and/or of a pressure sensor, extends at least at one end out of the crankcase. In this case, it is advantageous to connect the line leading to the high-pressure pump and the pressure sensor on the same end of the common rail.

Other objects, advantages and novel features of the present invention will become apparent from the following detailed description of the invention when considered in conjunction with the accompanying drawings.

DETAILED DESCRIPTION OF THE DRAWINGS

Figure 1:
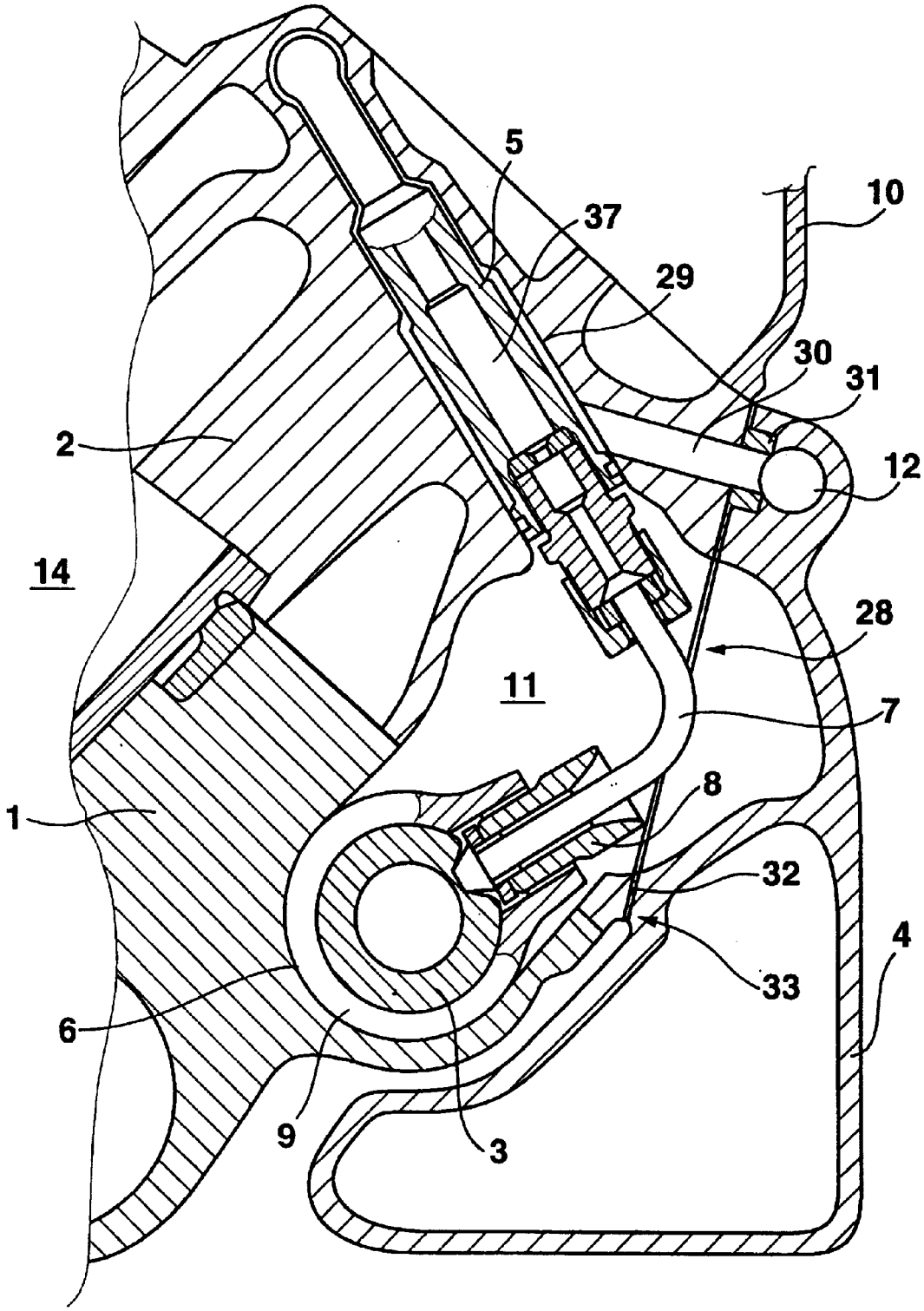
FIG. 1 is a cross-sectional view taken along Line I—I in FIG. 5 of a portion of the cylinder head of an internal-combustion engine containing a fuel injection system according to a preferred embodiment of the present invention.

FIG. 1 is a cross-sectional view of a portion of a cylinder head of an internal-combustion engine which illustrates important components of the fuel injection system according to the invention. The internal-combustion engine has a crankcase 1 of which only a small portion is illustrated in the figure, and several cylinder heads, of which one cylinder head 2 is illustrated, as well as a cylinder head cover 10. A high-pressure line 5 having an intermediate storage device 37 and a return flow throttle is arranged in a groove 29 of the cylinder head 2. The high-pressure line 5 leads by way of a pressure piece 42 to a fuel injector 36 (see FIG. 5) which is used for the injection of fuel into the assigned combustion space—the cylinder 14—of the internal-combustion engine. In the area of the line section 7, the high-pressure line 5 is connected by way of a connection 8 with a common rail 3. Fuel is fed to the common rail 3 by means of a high-pressure pump not shown in the figure and is stored there under pressure in the manner of an oil-elastic storage device, and when the fuel injector 36 is operated, is delivered at a defined point in time and in a defined quantity into the combustion space of the internal-combustion engine. To this extent, the illustrated fuel injection system corresponds to the prior art.

The common rail 3 is arranged in the upper portion of the crankcase 1 facing the cylinder head 2, in a duct 6 extending in parallel to the longitudinal axis of the crankcase 1. In the illustrated embodiment, the common rail 3 is constructed in the form of a tube and the duct 6 is provided as a longitudinal bore extending in parallel to the longitudinal axis of the crankcase 1.

Figure 7:
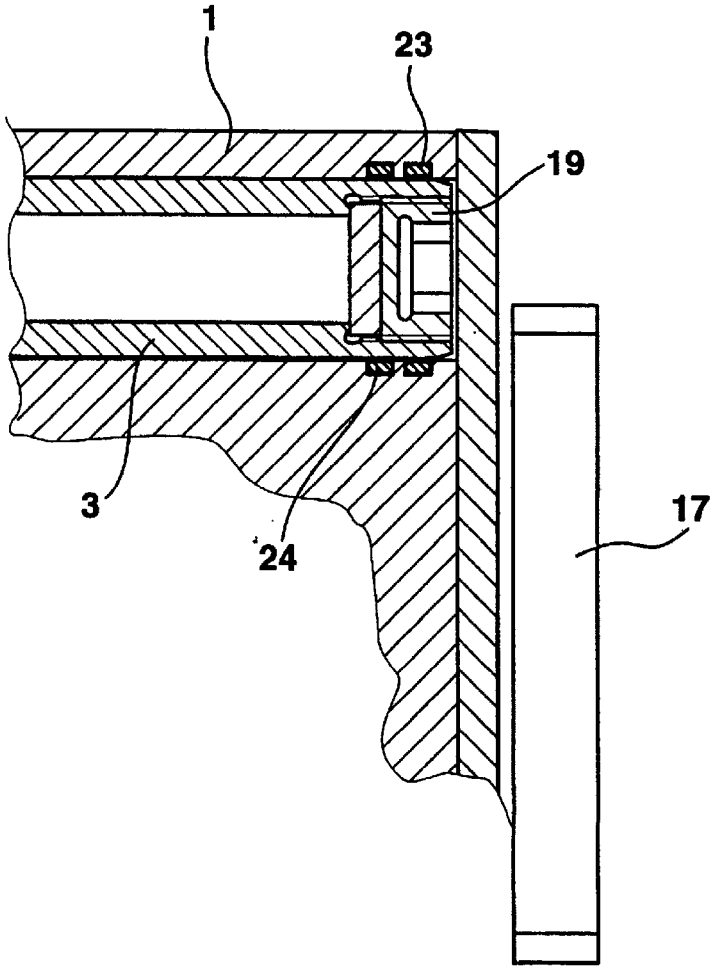
FIG. 7 is a longitudinal sectional view of the other end of the common rail in the area of the end of the crankcase of the internal-combustion engine, taken along Line VII—VII of FIG. 5.

As illustrated in FIG. 7, which is a longitudinal sectional view of one of the ends of the common rail, this common rail is disposed by means of O-rings 23 in the crankcase 1, in which case these O-rings 23 are arranged in grooves 24 in the longitudinal bore 6.

As further illustrated in FIG. 1, a mounting opening 28 is provided on the side of the cylinder head 2, through which mounting opening 28 the high-pressure lines 5 and 7 and the connection 8 of the high-pressure line 7 at the common rail 3 are accessible and mountable as well as demountable.

On the side of the internal-combustion engine, a charge air tube 4 is arranged which is used for supplying air to the combustion spaces of the internal-combustion engine, which air is preferably compressed by means of an exhaust gas turbocharger.

Figure 2:
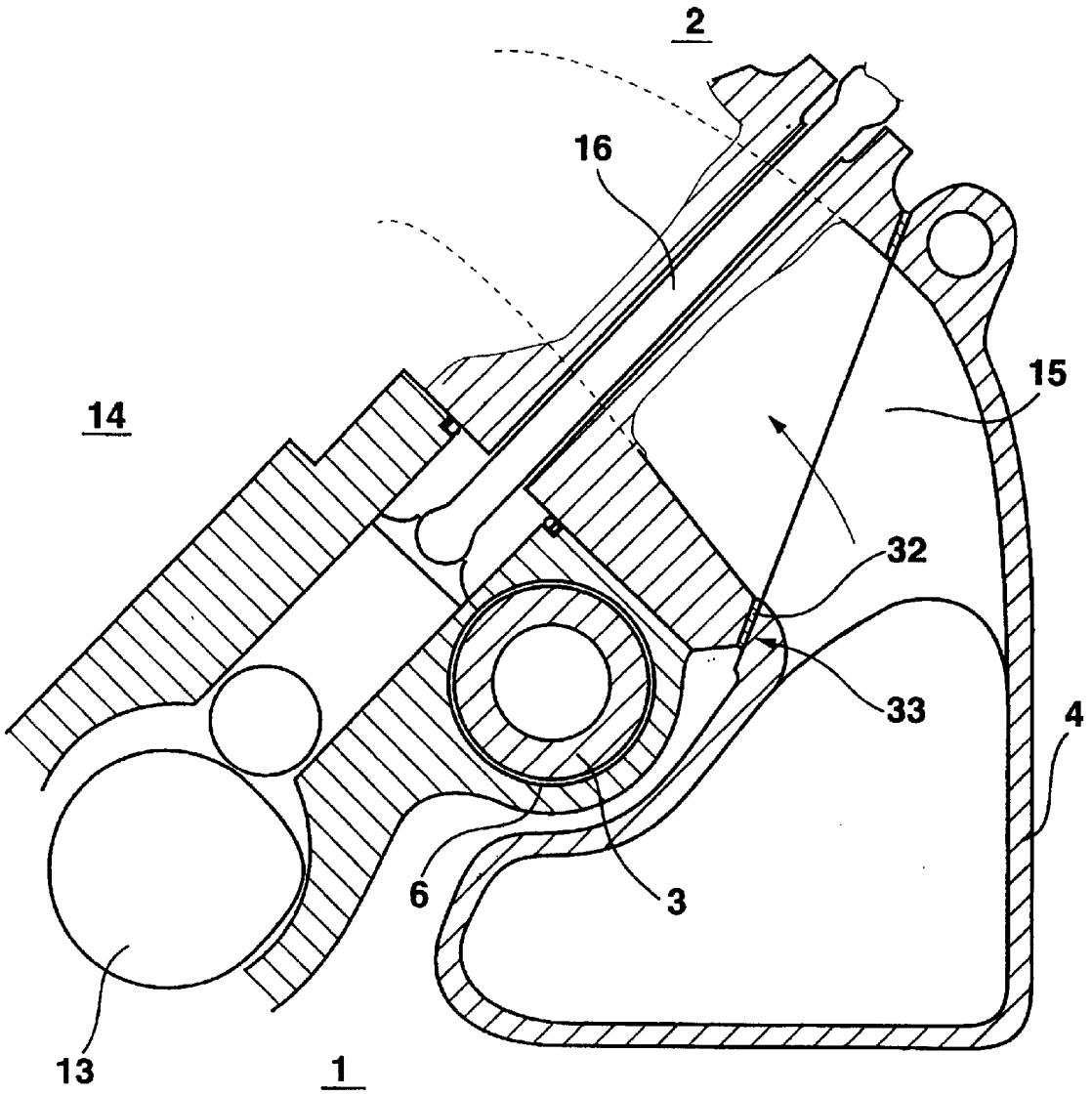
FIG. 2 is a sectional view taken along Line II—II in FIG. 5 of a portion of the same cylinder head as in FIG. 1.

FIG. 2 illustrates an inlet duct 15 leading from the charge air tube 4 to the combustion space of the internal-combustion engine, as well as the camshaft 13 and a tappet 16 of the valve gear of the internal-combustion engine. As shown, the inlet duct 15 is essentially in an alignment with the mounting opening 28; that is, in the case of an internal-combustion engine with cylinders 14 arranged in a row, the mounting openings 28 and the air inlet ducts 15 are essentially arranged in a row on the side of the cylinder head or cylinder heads and have a common sealing surface 33, on which a seal 32 is arranged which is provided between the cylinder head 1 and the charge air tube 4. While the air inlet duct 15 is connected with the air-carrying portion of the charge air tube 4, the portion of the charge air tube situated above the mounting opening 28 is closed off against the air-carrying portion so that the mounting opening 28 is hermetically closed off to the outside by the charge air tube 4 by means of the seal 32. Because of its position and arrangement, the charge air tube 4 can be considered to be part of the cylinder head 2 which is therefore constructed in two parts. The seal 32 is provided jointly for the air inlet ducts 15 and the mounting openings 28 of the cylinder heads 2 supplied by the charge air tube 4. As an alternative, the mounting openings 28 may also be closed by individual closing covers.

By means of the holding of the common rail 3 in receiving devices of the crankcase 1 of the internal-combustion engine and the hermetic closing-off of the space accommodating the high-pressure lines 5 and the injectors 36 by the charge air tube 4, the common rail 3 as well as the high-pressure lines 5 and 7 and the fuel injectors 36 are closed off in a liquid-tight manner to the outside, a liquid-tight leakage chamber 11 being formed which receives any fuel emerging at the screwed connections because of leakages or non-tight conditions. Such possibly occurring leakage quantities collect in a leakage drain 9 at the bottom of the duct 6. A control bore in the crankcase 1 of the internal-combustion engine provided at the level of the leakage drain 9 permits the indication of the occurrence of leakage quantities.

From the bores 29, which are connected with the bores 38, a leakage and control fuel duct 30 leads to a drain duct 12 extending in parallel to the longitudinal crankcase axis in the charge air tube 4, which drain duct 12 is used for receiving leakage and control fuel quantities occurring at the injectors 36. Such leakage and control fuel quantities, which occur directly at the injectors 36, are not delivered into the leakage chamber 11 provided in the area of the common rail 3 but collect inside the bore 38 and emerge by way of the leakage and control fuel duct 30 to the drain duct 12, by way of which they are returned to the fuel injection system. The leakage and control fuel ducts 30 also extend through the sealing surface 32 containing the mounting openings 28 and the air inlet ducts 15 and are sealed off there by seals 31.

Figure 3:
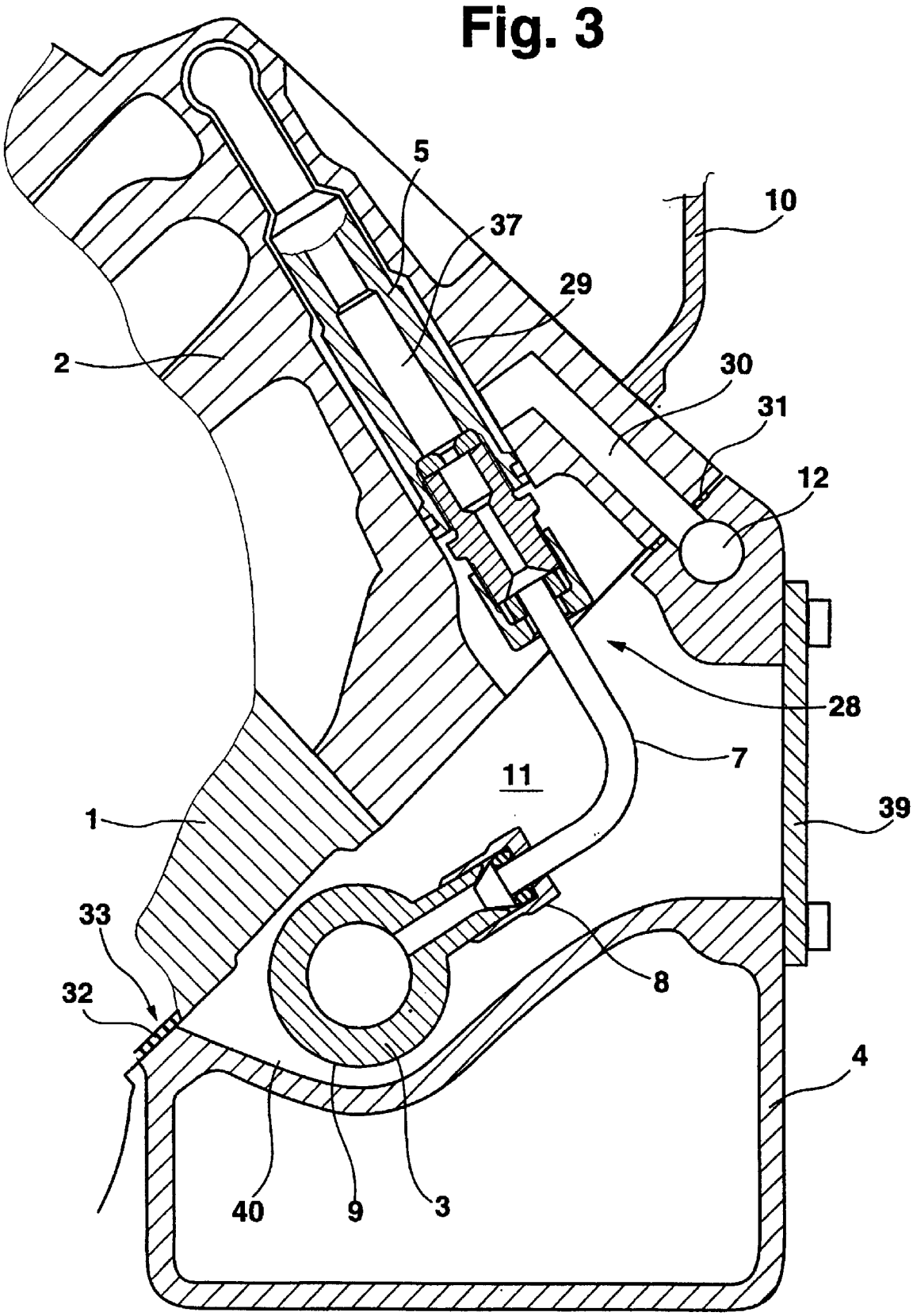
FIG. 3 is a cross-sectional view corresponding to that of FIG. 1 of another preferred embodiment.

As illustrated in FIG. 3, the common rail 3 is arranged between the crankcase 1 and a charge air tube 4. The parts of the fuel injection system essentially correspond to those of FIG. 1 and therefore have the same reference numbers. The duct 40 formed by the crankcase 1 and the charge air tube 4 extends in parallel to the longitudinal axis of the crankcase. Together with the leakage chamber 11, which is bounded by the charge air tube 4 and a closing cover 39 as well as the cylinder head 2 and crankcase walls, the duct 40 forms a liquid-tight space for the common rail. By demounting the closing cover 39 and/or the charge air tube 4, the parts of the high-pressure line system are accessible in a simple manner. In this case, the covering consisting of the charge air tube offers a space-saving protection for the high-pressure line system.

Figure 4:
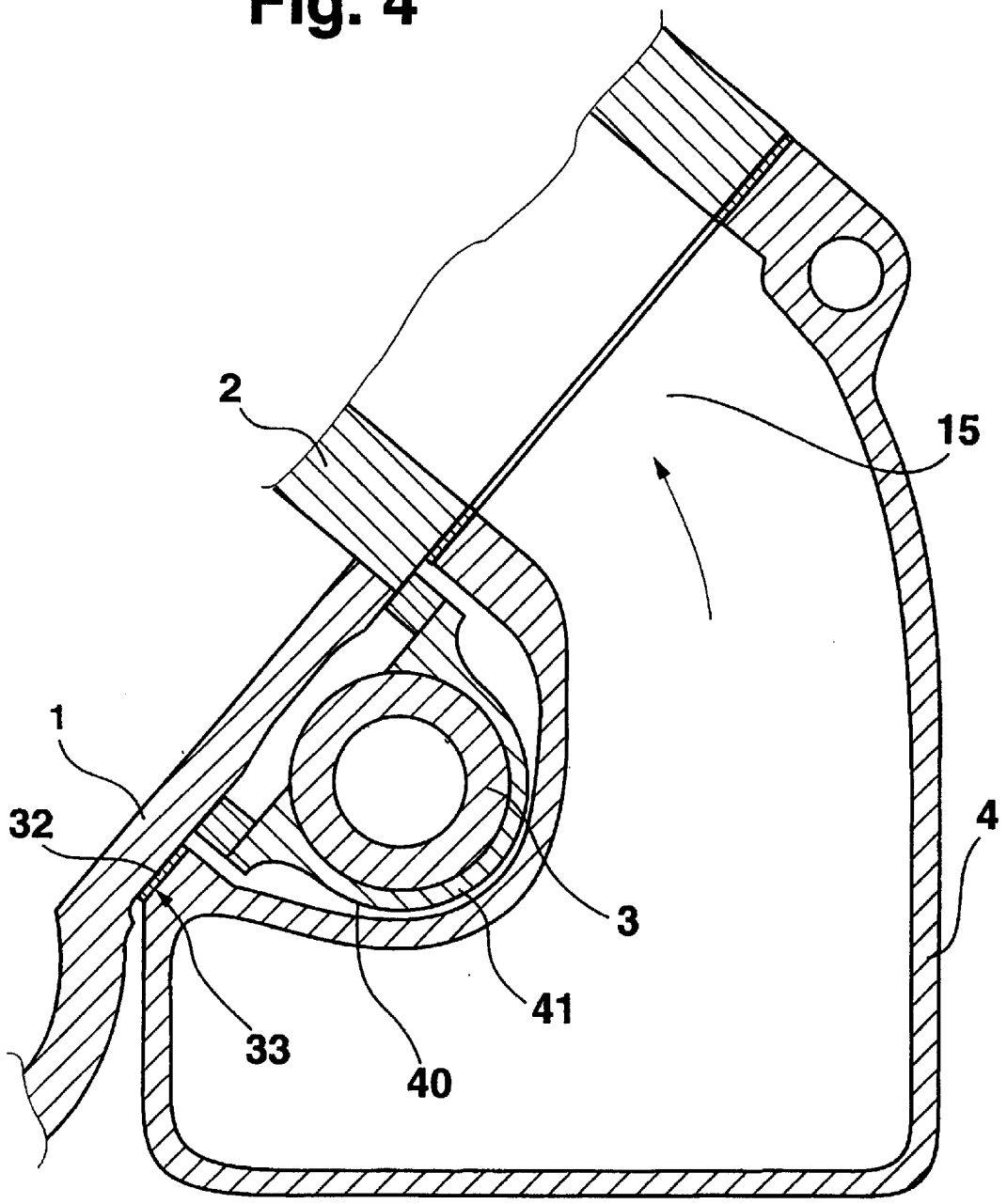
FIG. 4 is a sectional view corresponding to that of FIG. 2 of the embodiment according to FIG. 3.

FIG. 4, which illustrates a view of the embodiment according to FIG. 3 at the same location as shown in FIG. 2, shows the bearing of the common rail at the crankcase by means of holding clamps 41 which are screwed to the crankcase. Instead of using a bearing by means of clamps, it is also contemplated to support the common rail analogously to the embodiment of FIGS. 1 and 2, as illustrated in FIG. 7, by means of O-rings, which are inserted between the charge air tube 4 and the crankcase 1.

Figure 5:
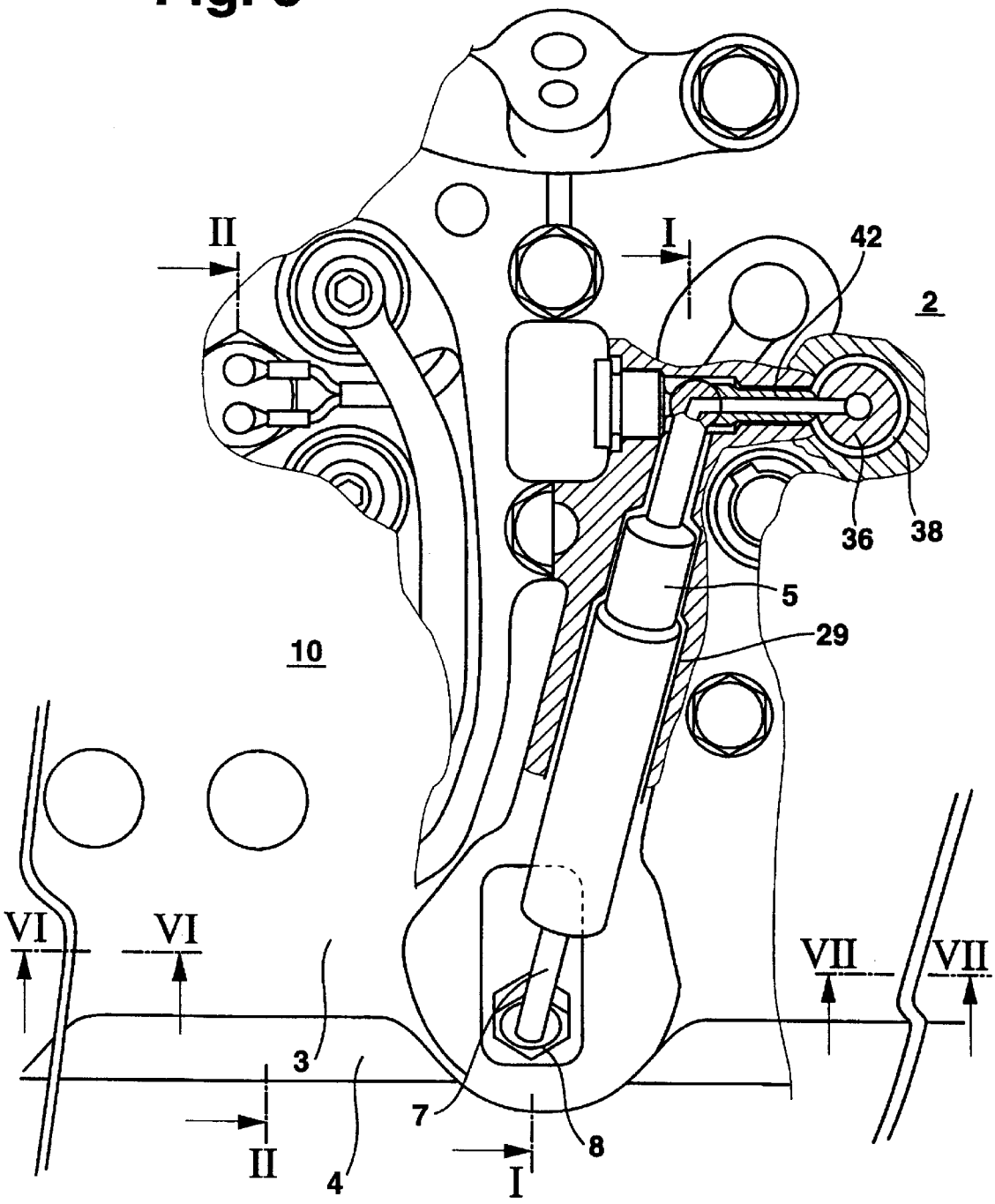
FIG. 5 is a top view of a portion of a cylinder head of an internal-combustion engine with a fuel injection system according to a preferred embodiment of the present invention.

FIG. 5 is a top view of a cylinder head of an internal-combustion engine in which an injector 36 is illustrated which has a leakage and control bore 38. The high-pressure line 5 is connected by way of a pressure piece 42 with the injector 36. The bores 38 and 29 are connected with one another for removing leakage fuel and control fuel.

Figure 6:
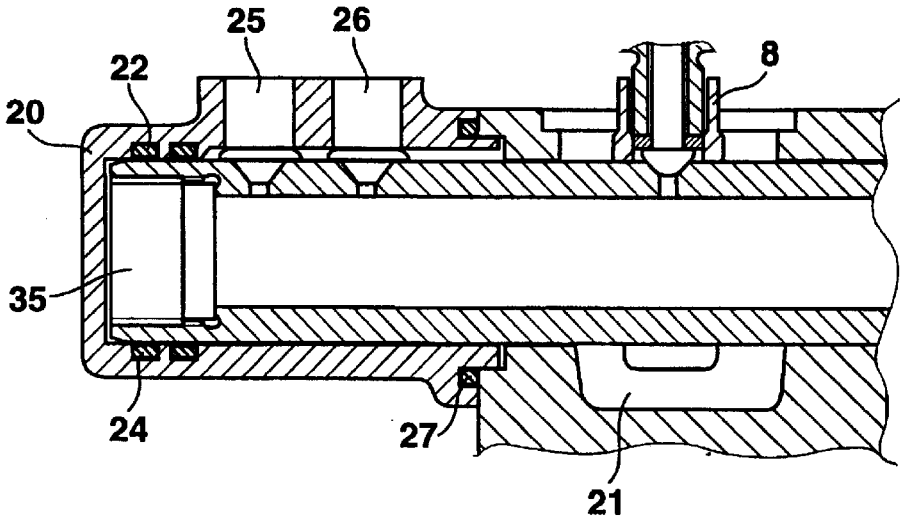
FIG. 6 is a longitudinal sectional view of an end of a common rail of the fuel injection system, which extends out of the crankcase of the internal-combustion engine, taken along Line VI—VI in FIG. 5.

As illustrated in FIG. 6, the common rail 3 is guided at an end of the crankcase 1 out of this crankcase 1 and is provided with a connection 25 for a high-pressure pump supplying the common rail 3 with fuel and a connection 26 for a pressure sensor for monitoring the pressure in the common rail 3. These connections 25 and 26 are provided in a shield 20 covering the led-out end of the common rail 3, which shield 20 supports the common rail 3 by means of O-rings 22 arranged in grooves 24 and is sealed off with respect to the crankcase 1 by means of an O-ring 27. The end of the common rail 3 is closed off by means of a closing stopper 35 which is screwed into an internal thread provided there and has a sealing plate. FIG. 6 also includes a longitudinal sectional view of the connection 8 for the high-pressure line 7 which connection is surrounded by a leakage chamber 21. All connections of high-pressure lines to the common rail 3 are implemented by conical seals and locking screws.

FIG. 7 shows the second end of the common rail 3 which is situated at the end of the crankcase 1 which has a wheel drive for controlling inlet and outlet valves of the internal-combustion engine. Only a camshaft wheel 17 is illustrated. This end is disposed in the bore 6 by means of O-rings arranged in grooves 24 and is simultaneously sealed off with respect to them. This end of the common rail 3 is closed off by means of a closing stopper 19, which is screwed into an internal thread provided there and has a sealing plate.

[List of Reference Numbers

1 Crankcase
2 cylinder head
3 common rail
4 charge air tube
5 high-pressure line
6 bore
7 high-pressure line
8 connection of high-pressure line
9 leakage drain
10 cylinder head cover
11 leakage chamber
12 leakage fuel drain duct
13 camshaft
14 cylinder
15 inlet duct
16 tappet
17 camshaft wheel
18 closing stopper
19 closing stopper
20 shield
21 leakage chamber
22 O-ring
23 O-ring
24 groove
25 connection for high-pressure pump
26 Connection for pressure sensor
27 O-ring
28 mounting opening
29 bore for injector
30 duct for leakage and control fuel quantity
31 seal
32 seal
33 sealing surface
34 seal
35 closing stopper
36 injector
37 intermediate storage device
38 bores -continued

[List of Reference Numbers 39 closing cover
40 duct
41 holding devices
42 pressure piece]

What is claimed is:

1. Fuel injection system for an internal-combustion engine, comprising:

a crankcase;

at least one cylinder head;

fuel injectors communicating with combustion spaces of the internal-combustion engine; and a common rail which feeds fuel to the fuel injectors by way of a high-pressure line system, wherein the common rail is accommodated in a duct which is formed by walls of the crankcase and by a charge air tube.

2. Fuel injection system according to claim 1, wherein the common rail has a tube-shaped construction.

3. Fuel injection system according to claim 2, wherein the tube-shaped common rail is accommodated in longitudinal bores of the crankcase which extend in parallel to the longitudinal axis of the crankcase.

4. Fuel injection system according to claim 1, wherein the common rail is supported via holding devices fastened on the crankcase.

5. Fuel injection system according to claim 1, wherein the common rail (3) is supported via O-rings.

6. Fuel injection system according to claim 1, wherein the common rail is closed off in a liquid-tight manner.

7. Fuel injection system according to claim 6, wherein the duct accommodating the common rail forms a liquid-tight leakage chamber which is provided with devices for draining leakage quantities.

8. Fuel injection system according to claim 7, wherein the leakage chamber has a control bore for indicating occurring leakage quantities.

9. Fuel injection system according to claim 1, wherein the high-pressure line system connecting the fuel injectors with the common rail includes an intermediate storage device, the high-pressure line system being arranged in the internal-combustion engine in a closed-off manner.

10. Fuel injection system according to claim 8, wherein the fuel injectors are arranged in bores and the high-pressure system are arranged in bores of the cylinder head in a closed-off manner.

11. Fuel injection system according to claim 10, wherein the common rail is arranged close to the cylinder head in the crankcase, and wherein the common rail has high-pressure connections which are accessible through mounting openings provided in at least one of the crankcase and the cylinder head, said high-pressure line system being connected to said high-pressure connections.

12. Fuel injection system according to claim 11, wherein the high-pressure connections, the fuel injectors, and the high-pressure line system are accessible and mountable by way of said mounting openings.

13. Fuel injection system according to claim 11, wherein the mounting openings are closed by closing covers.

14. Fuel injection system according to claim 11, wherein the cylinder head has a multipart construction, and wherein the mounting openings are closed off by a demountable part of the cylinder head.

15. Fuel injection system according to claim 14, the demountable part of the cylinder head is the charge air tube.

16. Fuel injection system according to claim 15, wherein the mounting openings are provided laterally on the cylinder head and are closed off by the charge air tube.

17. Fuel injection system according to claim 16, wherein air inlet ducts lead from the charge air tube to the combustion spaces of the internal-combustion engine, said air inlet ducts and said mounting openings being arranged essentially in a row in a sealing surface between the cylinder head and the charge air tube.

18. Fuel injection system according to claim 17, wherein the mounting openings and the air inlet ducts are sealed off on the sealing surface by a common seal.

19. Fuel injection system according to claim 17, wherein the charge air tube has a drain duct which extends in parallel to the longitudinal axis of the crankcase, said drain duct receiving leakage and control fuel quantities which occur at the fuel injectors, into which drain duct leakage and control fuel ducts lead which extend to the bores.

20. Fuel injection system according to claim 19, wherein the leakage and control fuel ducts are connected with the bores accommodating the fuel injectors and the high-pressure line system, and wherein the fuel injectors are constructed to deliver the leakage and control fuel quantities into the bores.

21. Fuel injection system according to claim 19, wherein the leakage and control fuel ducts extend through the sealing surface containing the mounting openings and are sealed off in the sealing surface by means of seals.

22. Fuel injection system according to claim 1, wherein the common rail extends out of the crankcase at least on one end for connection to at least one of a high-pressure pump and a pressure sensor.

23. Fuel injection system according to claim 22, further comprising a connection for the high-pressure pump and a connection for the pressure sensor located at one end of the common rail.

24. A crankcase for an internal-combustion engine having at least one cylinder head, fuel injectors communicating with combustion spaces, and a common rail supplying fuel to the fuel injectors by way of a high-pressure line system, said crankcase comprising:

crankcase walls and a charge air tube which define a duct for accommodating said common rail.

25. A method of making a crankcase for an internal-combustion engine having at least one cylinder head, fuel injectors communicating with combustion spaces, and a common rail supplying fuel to the fuel injectors by way of a high-pressure line system, said method comprising:

forming a duct in crankcase walls and a charge air tube, said duct being configured to accommodate said common rail.

* * * * *